US006993267B2

(12) United States Patent
Yoshiyuki et al.

(10) Patent No.: US 6,993,267 B2
(45) Date of Patent: Jan. 31, 2006

(54) IMAGE CARRIER UNIT AND IMAGE FORMING APPARATUS

(75) Inventors: Kimura Yoshiyuki, Tokyo (JP); Murakami Eisaku, Tokyo (JP); Zemba Hideki, Kawasaki (JP); Kurimoto Eiji, Numazu (JP); Nagashima Hiroyuki, Yokohama (JP); Yoshizawa Hideo, Saitama (JP)

(73) Assignee: Ricoh Company, Limited, Tokyo (JP)

( * ) Notice: Subject to any disclaimer, the term of this patent is extended or adjusted under 35 U.S.C. 154(b) by 107 days.

(21) Appl. No.: 10/703,447

(22) Filed: Nov. 10, 2003

(65) Prior Publication Data

US 2004/0190936 A1 Sep. 30, 2004

(30) Foreign Application Priority Data

Nov. 8, 2002 (JP) ..... 2002-325226
Aug. 29, 2003 (JP) ..... 2003-305697

(51) Int. Cl.
*G03G 15/00* (2006.01)
*G03G 21/18* (2006.01)

(52) U.S. Cl. ..... 399/114; 399/102; 399/111

(58) Field of Classification Search ..... 399/114, 399/111, 116, 102, 110, 106, 159
See application file for complete search history.

(56) References Cited

U.S. PATENT DOCUMENTS

| | | | | |
|---|---|---|---|---|
| 5,231,453 | A * | 7/1993 | Nakai et al. | 399/114 |
| 5,292,603 | A * | 3/1994 | Sakai et al. | 399/159 X |
| 5,974,287 | A * | 10/1999 | Kurz et al. | 399/114 |
| 6,070,037 | A | 5/2000 | Sugihara et al. | 399/274 |
| 6,085,062 | A | 7/2000 | Mizuishi et al. | 399/358 |
| 6,091,916 | A * | 7/2000 | Dycher | 399/114 |
| 6,144,822 | A | 11/2000 | Yamaguchi et al. | 399/121 |
| 6,148,161 | A | 11/2000 | Usui et al. | 399/58 |

(Continued)

FOREIGN PATENT DOCUMENTS

| | | |
|---|---|---|
| JP | 59-061848 | 4/1984 |
| JP | 01-155366 | 6/1989 |
| JP | 01-179952 | 7/1989 |
| JP | 05-080600 | 4/1993 |
| JP | 06-317963 | 11/1994 |

(Continued)

*Primary Examiner*—Sophia S. Chen
(74) *Attorney, Agent, or Firm*—Oblon, Spivak, McClelland, Maier & Neustadt, P.C.

(57) ABSTRACT

An image carrier unit, including a housing, an image carrier, and an opening configured to expose a portion of the image carrier. A seal member is configured to removably cover the opening of the housing, the seal member being made of a softer material than a material of the image carrier.

36 Claims, 5 Drawing Sheets

U.S. PATENT DOCUMENTS

| | | | | |
|---|---|---|---|---|
| 6,198,895 | B1 | 3/2001 | Tsuda et al. | 399/267 |
| 6,266,501 | B1 | 7/2001 | Mizuishi et al. | 399/106 |
| 6,317,573 | B1 * | 11/2001 | Baker et al. | 399/114 |
| 6,337,957 | B1 | 1/2002 | Tamaki et al. | 399/29 |
| 6,432,596 | B2 | 8/2002 | Ikuno et al. | 430/58.05 |
| 6,522,855 | B1 | 2/2003 | Katoh et al. | 399/274 |
| 6,553,202 | B2 | 4/2003 | Tamaki et al. | 399/258 |
| 6,573,016 | B2 | 6/2003 | Kami et al. | 430/58.05 |
| 6,641,964 | B2 | 11/2003 | Ikuno et al. | 430/66 |
| 6,653,033 | B1 | 11/2003 | Kami et al. | 430/58.05 |
| 6,687,474 | B2 | 2/2004 | Yamada et al. | 399/106 |

FOREIGN PATENT DOCUMENTS

| | | | |
|---|---|---|---|
| JP | 07-244454 | | 9/1995 |
| JP | 07-333960 | | 12/1995 |
| JP | 08-030173 A | * | 2/1996 |
| JP | 08-063081 A | * | 3/1996 |
| JP | 08-305247 | | 11/1996 |
| JP | 10-049032 | | 2/1998 |
| JP | 11-153937 | | 6/1999 |
| JP | 11-316535 | | 11/1999 |
| JP | 11-327362 A | * | 11/1999 |

* cited by examiner

IMAGE CARRIER UNIT AND IMAGE FORMING APPARATUS

CROSS-REFERENCE TO RELATED APPLICATIONS

This patent document claims priority to Japanese Patent Publication 2002-325226 filed Nov. 8, 2002, and 2003-305697 filed Aug. 29, 2003, the entire contents of each of which are hereby incorporated herein by reference.

BACKGROUND OF THE INVENTION

1. Field of the Invention

The present invention is directed to an electro-photographic image forming apparatus such as a printer, a facsimile device, a copy machine, etc., and is particularly directed to a replaceable process cartridge used in such an image forming apparatus.

2. Discussion of the Background

In an image forming device it is known to utilize an image carrier unit having a housing that contains an image carrier. Such an image carrier unit is replaceable to improve efficiency when such an image carrier unit becomes worn out or defective and needs to be replaced. Such an image carrier unit can be formed as a process cartridge that contains a developing device that develops an electrostatic latent image written on the surface of an image carrier and a cleaning unit that cleans a surface of the image carrier. Such a process cartridge also includes a housing with an opening that allows the image carrier to make contact with a transfer member, a paper sheet, etc.

In such an image forming device attention must be paid to avoiding contact with the image carrier through the opening in the housing. Particularly, attention must be paid that a worker's hand does not touch the image carrier when replacing the image carrier unit, or that foreign substances do not adhere to the image carrier. Light should also be prevented from impinging on the image carrier through the opening to prevent breakdown of the image carrier surface. Paying attention to the above-noted matters is particularly significant because the image carrier unit can be replaceably installed by a worker, and at that point must be handled by the worker.

Before an image carrier unit is installed into an image forming apparatus, the opening portion in the housing can be covered with a seal member. After the image carrier unit is installed into the image forming apparatus, the seal member is removed from the image carrier unit. An example of such an operation is disclosed in Japanese Patent Laid Open No. 59-61848. In that device a seal member is formed of a material such as a polyester film, which has a drawback that such a material is difficult to tear.

The present inventors recognized that an image carrier is particularly susceptible to damage because when a toner image on an image carrier is transferred to a transfer member or a paper sheet, it is necessary that some outer part of the image carrier protrude from an opening of the housing to contact the transfer member or paper sheet. As a result it becomes more difficult to protect that protruding portion of the image carrier.

The present inventors also recognized that when the opening of the housing is covered by a hard seal member, the outer layer of the image carrier may become damaged from contact with or rubbing against the hard seal member. Particularly when transporting the image carrier unit, for example prior to installing the image carrier unit, vibration caused by rotation of the image carrier may more easily result in contact between the outer layer of the image carrier and the hard seal member, again resulting in damage to the outer layer of the image carrier.

SUMMARY OF THE INVENTION

Accordingly, one object of the present invention is to address the above-noted and other drawbacks in the background art.

A more specific object of the present invention is to provide a novel image carrier unit structure in which an outer layer of an image carrier, particularly if it protrudes from an opening of a housing, is effectively protected against damage.

Another object of the present invention is to provide a novel seal structure for a novel image carrier unit and image forming device that is easy to implement, but that still properly protects an image carrier from damage particularly during transporting thereof, and that also protects the image carrier from light.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
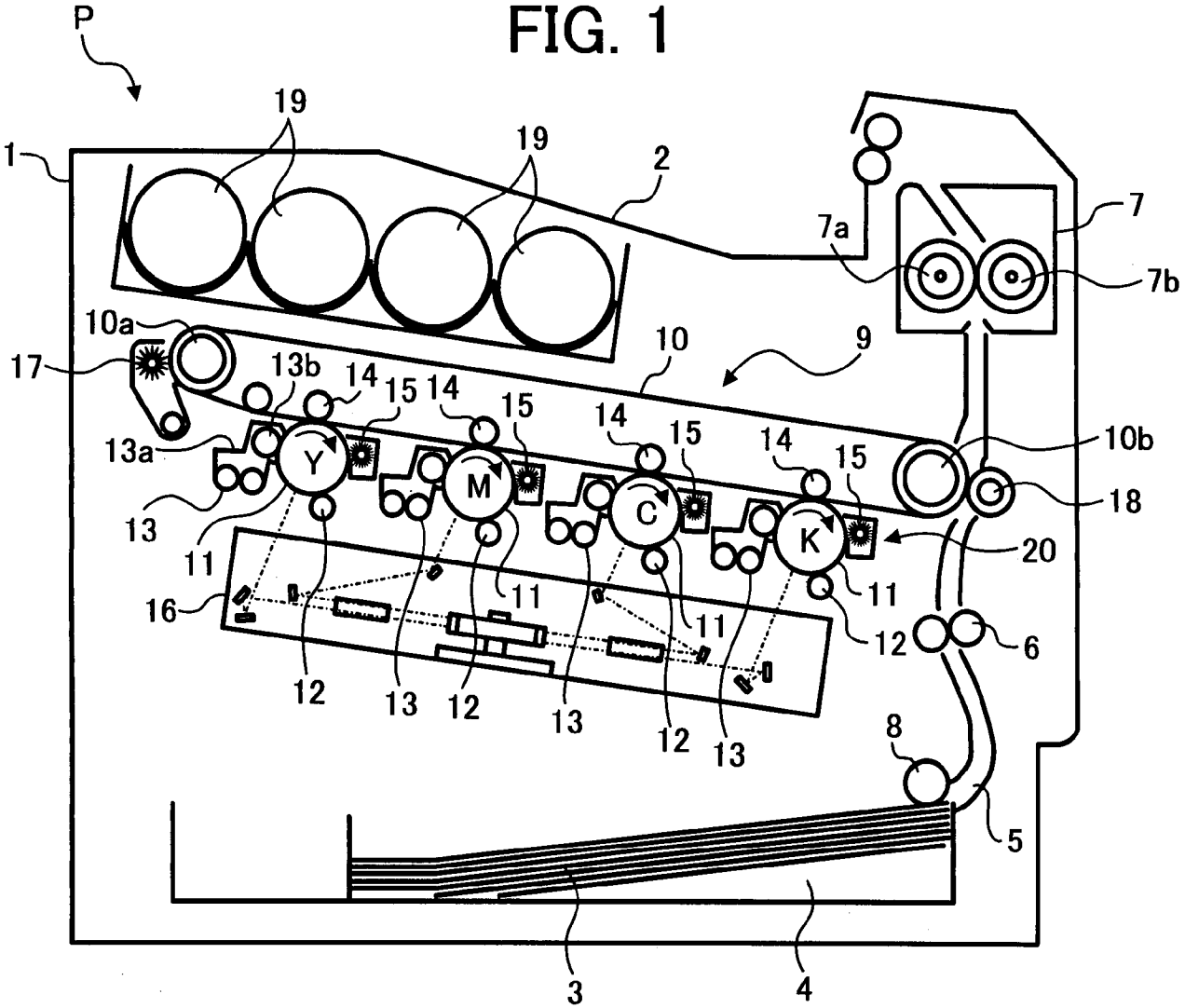
FIG. 1 shows an interior construction of a printer according to an embodiment of the present invention.

Referring now to the drawings, wherein like reference numerals designate identical or corresponding parts throughout the several views, and more particularly to FIG. 1 thereof, a color printer P as an example of an image forming device to which the present invention is applicable is shown. The present invention is applicable to other image forming devices than a color printer, as would be apparent to those of ordinary skill in the art.

As shown in FIG. 1, the color printer P includes a main body 1 and an ejection portion 2 at a top of the main body 1. That ejection portion 2 receives paper sheets that have had images printed thereon, from the main body 1.

In the main body 1 a stack of paper sheets 3 is piled on a paper feed portion 4. Further, a paper conveyance path 5 is provided such that the paper sheets 3 piled on the paper feed portion 4 can be conveyed to the ejection portion 2. A paper conveyance roller pair 6 is formed in the paper conveyance path 5, and a fixing unit 7 is provided further downstream of the paper conveyance roller pair 6. A paper feed roller 8 is provided to feed the paper sheets 3 one at a time from the paper feed portion 4.

Figure 2:
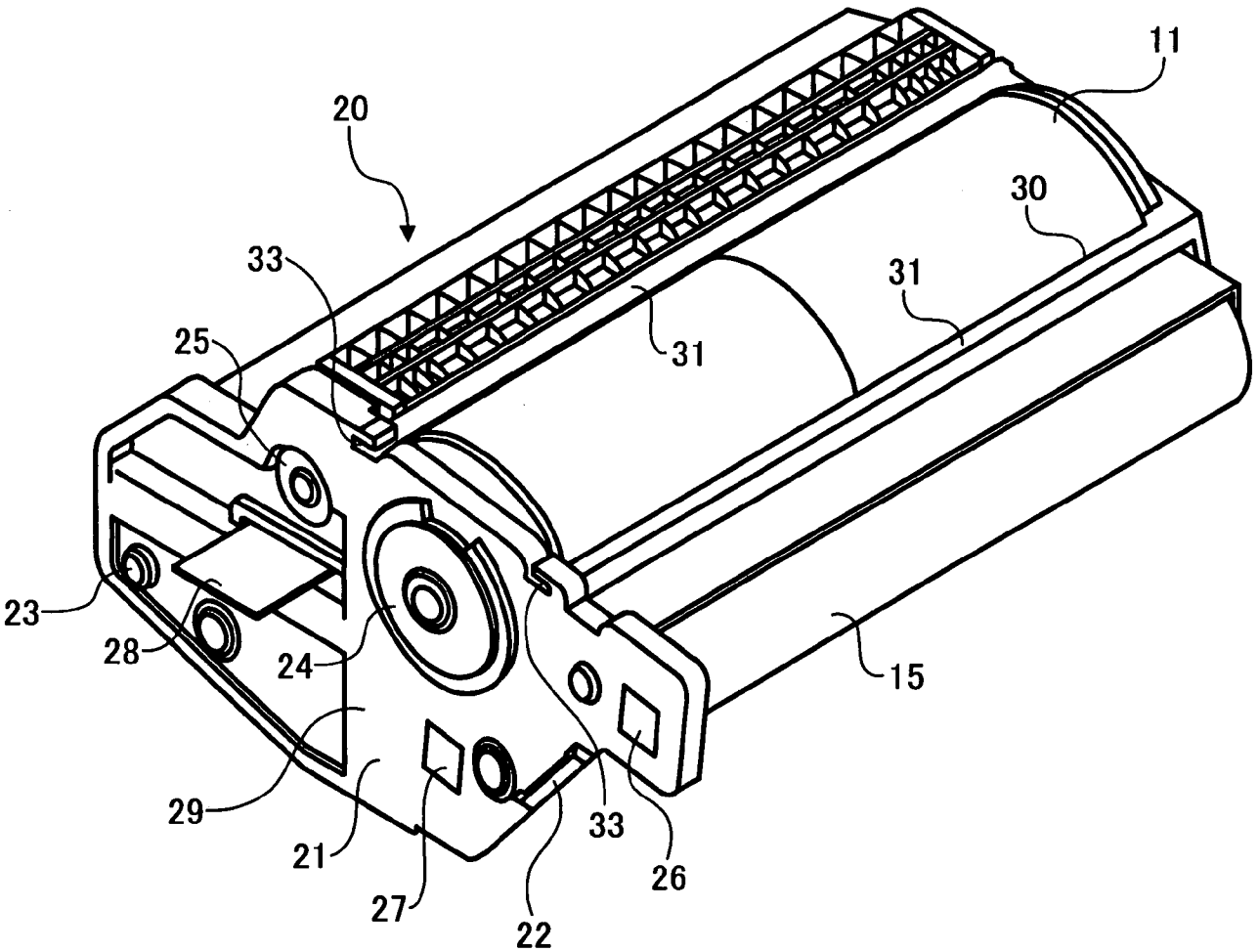
FIG. 2 shows an exterior construction of a cartridge used in the printer of FIG. 1.

Further, within the main body 1 of the color printer P an image forming portion 9 is provided. The image forming portion 9 includes an intermediate transfer belt 10 supported by a drive roller 10*a* and a driven roller 10*b*. Four photoconductor units 20 are disposed along the intermediate transfer belt 10 in the rotation direction of the intermediate transfer belt 10. The four photoconductor units 20 each individually include a photoconducting portion forming a toner image of a respective color of Y (yellow), M (magenta), C (cyan), and K (black). The details of each photoconducting unit 20 are shown in FIGS. 2–5. FIG. 2 shows a representative photoconducting unit 20 without a seal member, the seal member being described in further detail with respect to FIGS. 3–5.

Each photoconductor unit 20 includes a housing 21, a photoconductor roller 11 that rotates within the housing 21, a charging roller 12 deployed around the photoconductor roller 11, a developing device 13, a first transfer roller 14, and a cleaning unit 15. The developing device 13 includes a developer accommodation portion 13*a* and a developer roller 13*b*.

Further, the image forming portion 9 includes an exposure unit 16 to form an electrostatic latent image onto the surface of each photoconductor roller 11, and a cleaning unit 17 to clean intermediate transfer belt 10. The exposure unit 16 includes various optical components such as lenses, a polygonal mirror, etc.

A second transport roller 18 is also provided in contact with the driven roller 10*b* to contact the intermediate transfer belt 10 under a pressure. In addition, developer (e.g. toner) is replenished to each developing device 13 from toner in various toner bottles 19.

The fixing unit 7 includes a heating roller 7*a* with a heating function and a pressure roller 7*b*. An image can be fixed onto paper sheets 3 passing through the fixing unit 7 by the heating roller 7*a* and the pressure roller 7*b*.

An operation of image forming in the color printer P is now described.

In the image forming portion 9, the surface of the photoconductor roller 11 for each photoconductor unit 20 is charged by the charging roller 12. An electrostatic latent image corresponding to desired image data is then formed on each photoconductor roller 11 by a signal output from the exposure unit 16. Each electrostatic latent image is then developed by a respective developing device 13, and thereby a toner image is formed on each photoconductor roller 11. The toner images formed on each respective photoconductor roller 11 are then transferred to the surface of the intermediate transfer belt 10 by the respective transfer rollers 14, in registration.

Also, paper sheets 3 piled up on the paper feed portion 4 are then fed to contact the tip portion of the paper conveyance roller pair 6 by the paper feed roller 8. Each individual paper sheet 3 is then conveyed to the nip portion between the transfer belt 10 and the second transfer roller 18 by the paper conveyance roller pair 6, and thereby a toner image on the intermediate transfer belt 10 is then transferred to the paper sheet 3. The paper sheet 3 then subsequently passes through the fixing unit 7, and the toner image on the paper sheet 3 is fixed by the fixing unit 7. The paper sheet 3 with a fixed image is then ejected to the ejection portion 2.

Further, after the above-noted operation residual toner remaining on the different photoconductor rollers 11 is removed by their respective cleaning units 15. The photoconductor rollers 11 are then electrically neutralized at the same time by their respective charging rollers 12. With those operations the photoconductors rollers 11 are then in a state in which they are ready to execute a next image forming process.

Further, residual toner from the intermediate transfer belt 10 is cleaned by the cleaning unit 17, so that the intermediate transfer belt 10 is also then ready for a next image forming operation.

It is also noted that in the color printer P of FIG. 1 the respective first transfer rollers 14 corresponding to photoconductor rollers 11 of the photoconductor units 20 forming toner images of yellow (Y), magenta (M), and cyan (C) can be held in a state in which they do not contact the intermediate transfer belt 10 in an operation in which only a monochrome black image is formed. In that operation only the transfer roller 14 corresponding to the black (K) photoconductor unit 20 is held in contact with the intermediate transfer belt 10. Further, at a time of exchanging any of the different photoconductor units 20, it may be desirable to place all of the transfer rollers 14 in a position in which none of the transfer rollers 14 contact the intermediate transfer belt 10. A mechanism provided in the main body 1 to support the intermediate transfer belt 10 and to move the first transfer rollers 14 to either contact the intermediate transfer belt 10 or to be spaced apart from the intermediate transfer belt 10 is not detailed in FIG. 1, but is known to those of ordinary skill in the art.

Specifics of the individual photoconductor units 20 are now further explained with reference to FIGS. 2–5. FIG. 2 shows a state of the photoconductor unit 20 without a sealing member for clarity's sake.

Each photoconductor unit 20 in the present embodiment includes a photoconductor roller 11, a charging roller 12, a developing device 13, and a cleaning unit 15, all placed inside a main housing 21. A handle 22 is also disposed at both side ends of an axis direction of the photoconductor roller 11 and a positioning portion 23 is provided to connect with the main body 1 of the color printer P, to ensure proper positioning of the photoconductor unit 20 in the color printer P. That handle 22 and positioning portion 23 are also formed in the housing 21.

The housing 21 further includes a feeding portion 27 that allows feeding a bias to the charging roller 12, a feeding portion 26 that allows feeding a bias to a diffusion brush 15*a* of the cleaning unit 15 (see FIG. 5), a feeding portion 25 that allows applying a developing bias to the developing roller 13*b* of the developing device 13 (see FIG. 5), and a ground member 24 to ground the photoconductor roller 11. In addition the ground member 24 functions as a support for the photoconductor roller 11.

As shown in FIG. 2, a developer seal member 28 is provided to protrude beyond a front portion 29 of the housing 21 underneath the developing bias feeding portion 25. That developer seal member 28 protects the photoconductor roller 11, and particularly prevents developer from adhering to the photoconductor roller 11 in transporting the photoconductor unit 20. That is, the developer seal member 28 seals a gap between the developer accommodating portion 13*a* and the developer roller 13*b* (see FIG. 1). Viewed at from the front portion 29 of the housing 21, the developer seal member 28 is adhered from a front end of the developer roller 13*b* towards a back end of the photoconductor unit 20, for example by heat melting or by two-sided tape. The developer seal member 28 is held back at a back end of the photoconductor unit 20, and is then pulled towards the front end to remove the developer seal member 28 after the photoconductor unit 20 has been installed into the image forming apparatus. By pulling towards the front end of the developer seal member 28, the developer seal member 28 is removed from the developing device 13 to open the portion between the developer accommodating portion 13*a* and the developing roller 13*b* when the photoconductor unit 20 is installed into the image forming apparatus.

Figure 4:
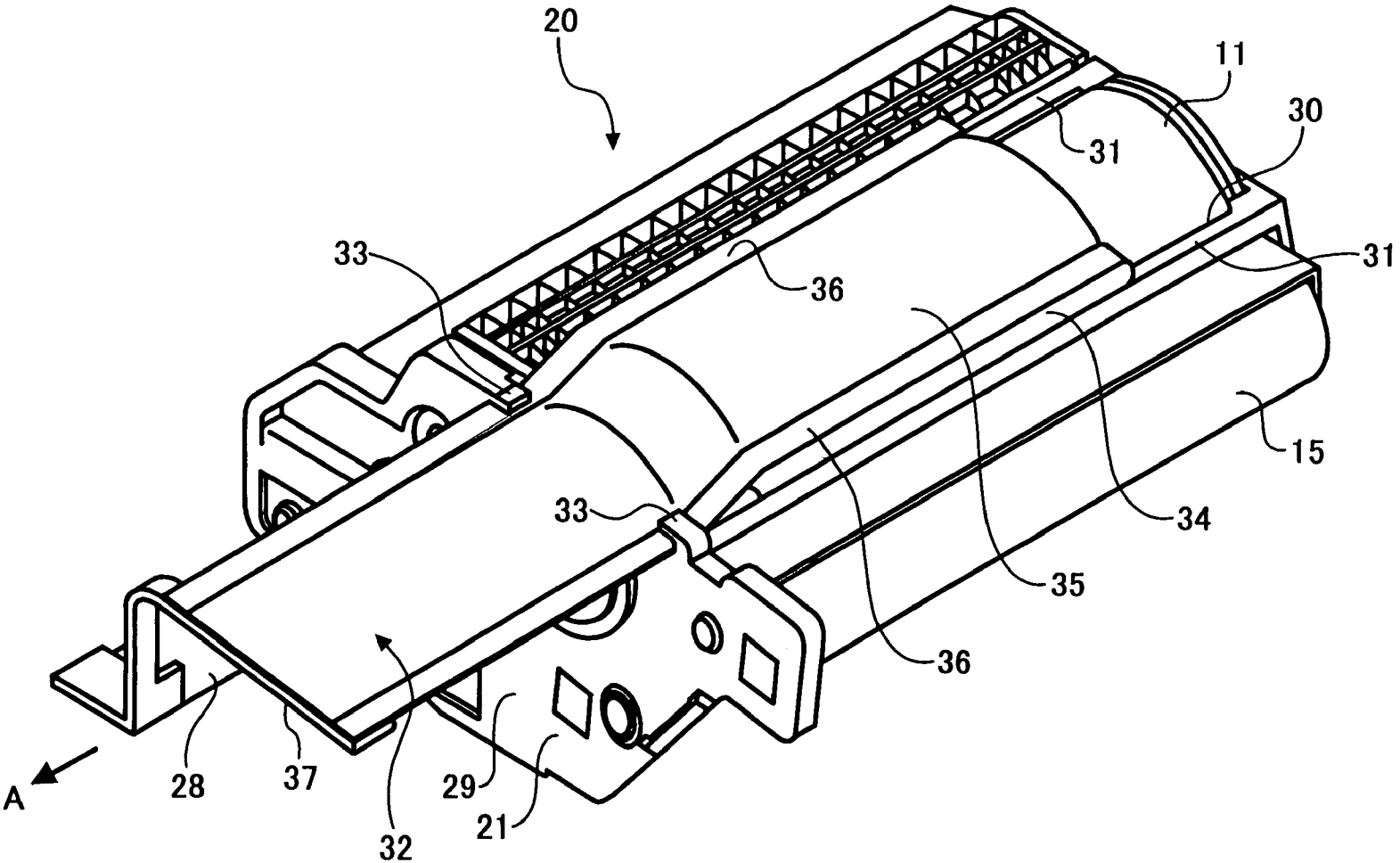
FIG. 4 shows an exterior construction of the cartridge of FIG. 2 in the process of tearing off a seal member.
Figure 5:
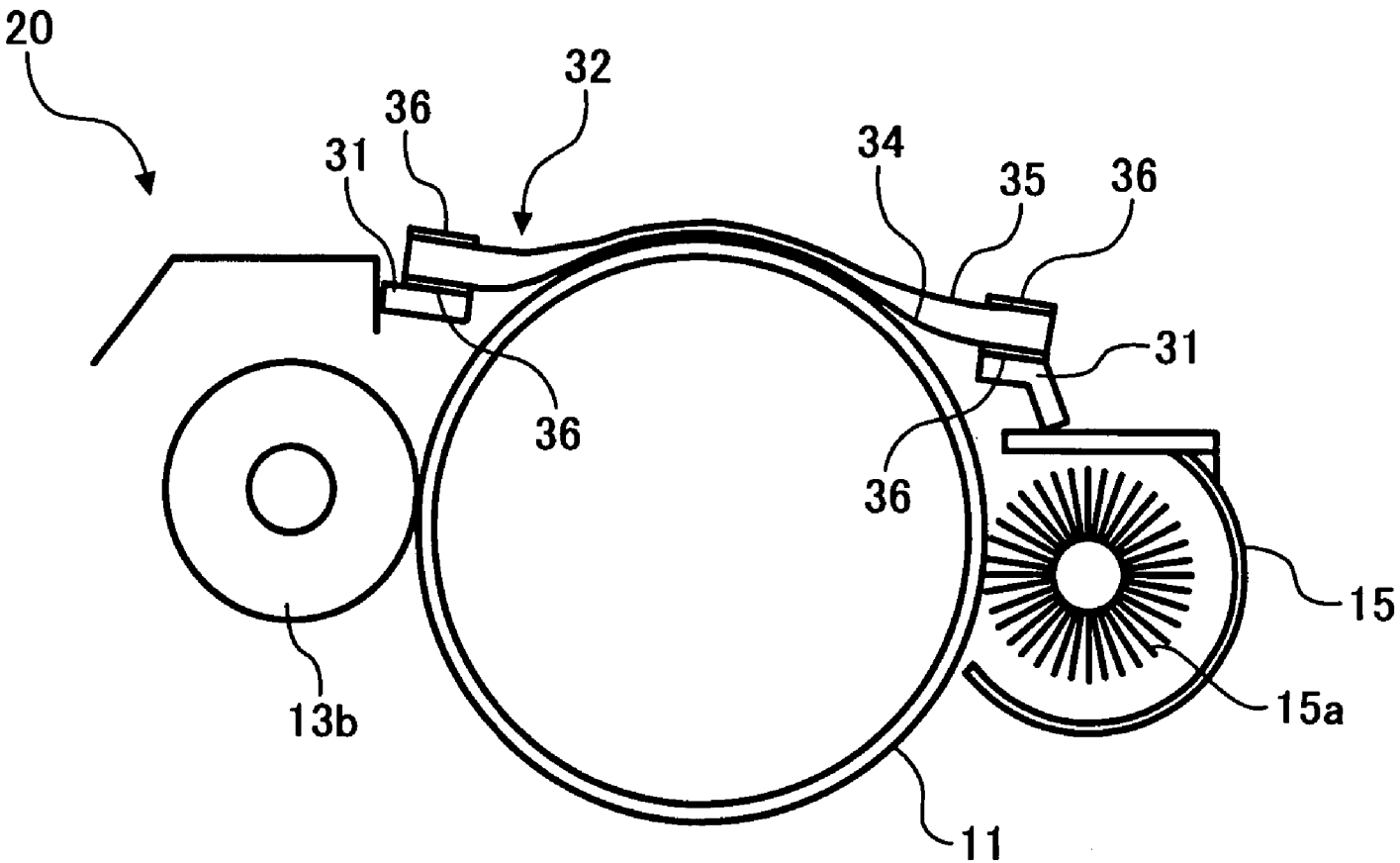
FIG. 5 shows in interior construction of the cartridge of FIG. 2.

As also shown in FIGS. 2 and 4, an opening portion 30 is formed at a top of the housing 21 to allow a portion of the photoconductor roller 11 to protrude from the housing 21. That structure allows the photoconductor roller 11 to contact the intermediate transfer belt 10 in the present embodiment. That structure could also allow the photoconductor roller 11 to directly contact a paper sheet.

Further, an adhesion portion 31 including a step is formed at both sides of the opening portion 30 along an axis direction of the photoconductor roller 11. As viewed from the front portion 29 of the housing 21, a guide portion 33 is further formed at a front end of the adhesion portion 31.

Figure 3:
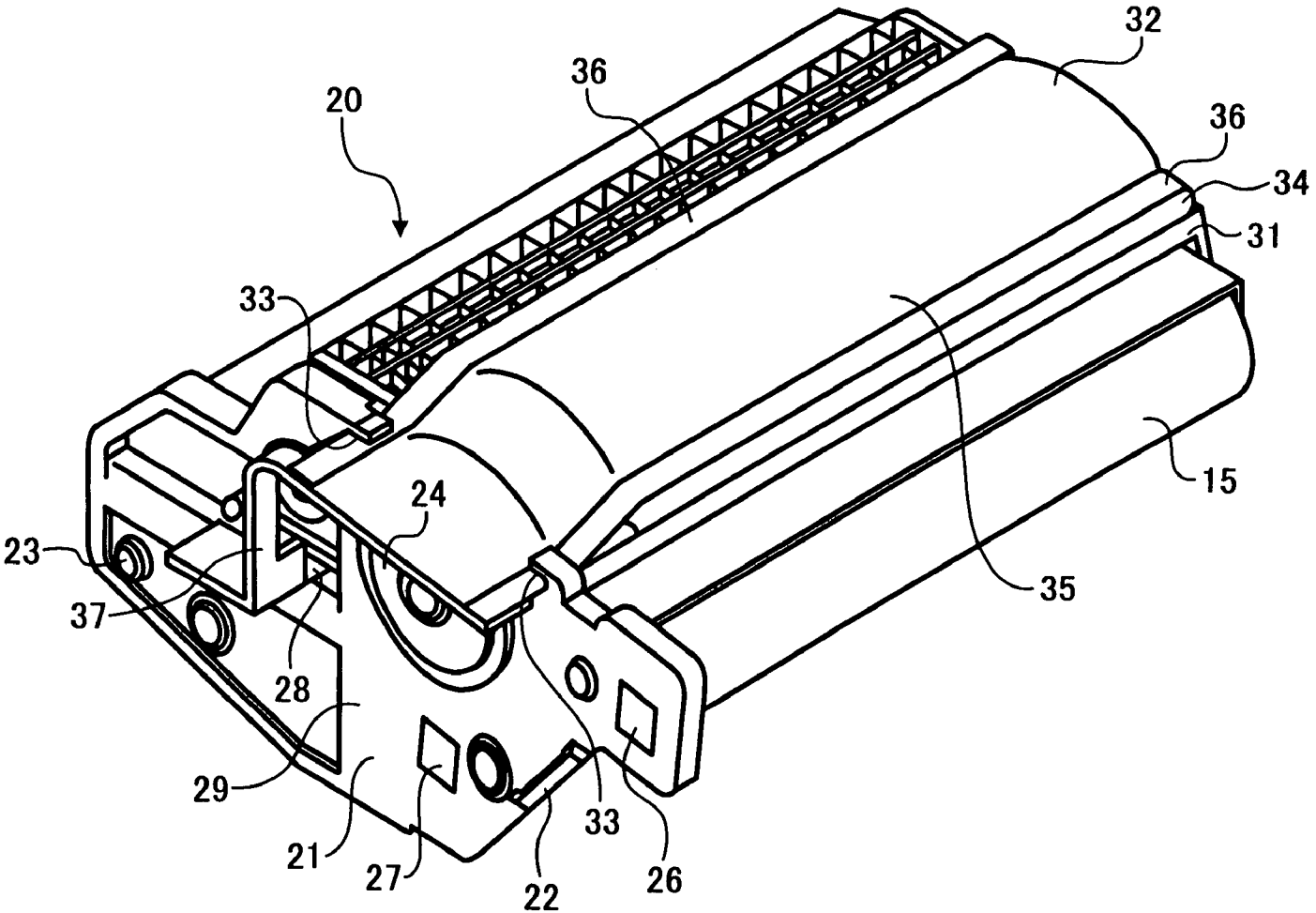
FIG. 3 shows an exterior construction of the cartridge of FIG. 2 before tearing off a seal member.

As shown in FIGS. 3 and 4, a further seal member 32 is provided to cover the opening portion 30. That further seal member 32 is formed of a soft flexible material that is softer than the surface of the photoconductor 11. As an example of materials that form the seal member 32, flexible materials such as polyurethane rubber with a thickness of about 0.2 mm can be utilized. Such polyurethane rubber should also be formed to be black to additionally achieve a light blocking effect.

The seal member 32 extends in an axis direction of the photoconductor roller 11 and has a central covering portion 35 that covers substantially all of the opening portion 30, and thereby that central cover portion 35 covers the portion of the photoconductor roller 11 protruding from the opening portion 30. That seal member 32 is turned-back on itself (i.e. is folded back to be U-shaped) so that a turned-back portion thereof is underneath the top surface. That turned-back portion 34 directly covers the photoconductor roller 11.

Further, the turned-back portion 34 is turned back at the ends thereof adjacent to the adhesion portion 31 of the housing 21. The turned-back portion 34 is turned back in an axis direction of the photoconductor roller 11.

Further, the seal member 32 includes a reinforcement portion 36 at each side of the central cover portion 35 and turned-back portion 34, and also formed in an axis direction of a photoconductor roller 11. The seal member 32 further includes a handle portion 37 that is attached at an end of the seal member 32. Handle portion 37 can be formed of a relatively hard material such as a resin. The seal member 32 is provided in the photoconductor unit 20 such that the reinforcement portions 36 go through the guide portions 33 of the housing 21. In removing the seal member 32 from the housing, the reinforcement portions 36 provide a good guide operation through the guide portion 33.

The reinforcement portions 36 can be formed by bending a polyester sheet of elastically hard millers (e.g., from the Dupont company) on either side of the seal member 32 as lining materials.

The seal member 32 can be bonded onto the adhesion portion 31 of the housing 21. That adhesion can be performed by specifically adhering the reinforcement portions 36 to the adhesion portion 31, the reinforcement portion 36 in turn being bonded to the main cover portions 35 and turned-back portion 34. The adhesion of the reinforcement portions 36 to the adhesion portion 31 of the housing can, for example, be effectuated by an adhesive, a two-sided tape, etc. The adhesion should not be so strong to prevent the seal member 32 from being removed by pulling the handle portion 37. The handle portion 37 is positioned at an end of the sealing member 32 and is also made rigid particularly with respect to the reinforcement portions 36, i.e. connected to the reinforcement portions 36.

When the handle portion 37 is pulled to tear off the seal member 32 from the housing 21, almost all of the tension acts on the reinforcement portions 36 so that the seal member 32 can be removed smoothly and without tearing.

In addition, one end of the developer seal member 28 can be fixed to the handle portion 37. With that structure, when the seal member 32 is torn off from the housing 21 by pulling the handle portion 37 in the direction indicated by the arrow A in FIG. 4, the seal member 28 is also torn off at the same time.

Further, the handle portion 37 can extend beyond the front face 29 of the photoconductor unit 20 such that if the seal member 32 and the developer seal member 28 are not properly removed, the front door of the image forming apparatus will not close. That prevents a user from forgetting to remove the seal member 32 and the developer seal member 28 from the photoconductor unit 20 after the photoconductor unit 20 is installed in an image forming apparatus.

With the photoconductor unit 20 with the structure as noted above, the seal member 32 can protect the photoconductor roller 11, particularly at a time when the photoconductor unit 20 is being transported and then installed into an image forming apparatus. Further, since the seal member 32 is made of a softer material than that of the photoconductor roller 11, even if the seal member 32 touches an outer layer of the photoconductor roller 11, particularly the portion of the photoconductor roller 11 protruding from the opening portion 30, the photoconductor roller 11 can still be prevented from being damaged.

Further, by bonding the seal member 32 to the adhesion portion 31 such that the seal member 32 is pulled in a width wise direction, i.e., at a right angle to an axis direction of the photoconductor roller 11, a stress state in the seal member 32 against the photoconductor roller 11 can be maintained. That is, the seal member 32 has the central cover portion 35 and the reinforcement portions 36 at both edges thereof, and additionally the turned-back portion 34 and the handle portion 37 fixed to the reinforcement portions 36 at an end of the turned-back portion 34. With such a structure, when the handle portion 37 is gripped to tear off the seal member 32 from the housing 21, a pulling force is transmitted directly to the reinforcement portions 36 so that the seal member 32 does not stretch. As a result the seal member 32 becomes easy to tear off.

Further, at a time of transporting or installing the photoconductor unit 20, relative movement of the photoconductor roller 11 and the seal member 32 can be controlled so that again any damage caused on the photoconductor roller 11 by contact with the seal member 32 can be further prevented. Further, the seal member 32 and the developer seal member 28 can be torn off from the housing 21 at a same time when a photoconductor unit 20 is changed by merely gripping the single handle portion 37 and pulling the single handle portion 37 in the direction indicated by the arrow A.

Further, the seal member 32 as noted above has a light blocking effect to prevent deterioration of the photoconductor roller 11 by light.

FIG. 4 shows a specific state in the process of removing the seal member 32 in which the developer seal member 28 is also removed when the handle 37 is pulled in the direction indicated by arrow A. In this case, although the seal member 32 is formed of a flexible material, since the reinforcement portions 36 are bonded to the adhesion portion 31, the central cover portion 35 of the seal member 32 can be prevented from stretching. Thereby, the seal member 32 can be easily torn off.

Further, when tearing off the seal member 32 from the housing 21 the reinforcement portions 36 are positioned on both sides of the seal member 32 and are guided by the guide members 33 in the housing 21. As a result, the seal member 32 can be pulled smoothly and in a straight direction so to again make the seal member 32 easy to tear off.

Obviously, numerous modifications and variations of the present invention are possible in light of the above teachings. It is therefore to be understood that within the scope of the appended claims, the present invention may be practiced otherwise than as specifically described herein.

What is claimed is:

1. An image carrier unit, comprising:
a housing;
an image carrier;
an opening in said housing configured to expose a portion of said image carrier;
a seal member configured to removably cover said opening in said housing by being moved from an installed to an uninstalled position in an axial direction of the image carrier, said seal member made of a softer material than a material of said image carrier, said seal member changing its shape when being moved from the installed to the uninstalled position.

2. The image carrier unit of claim 1, wherein said seal member has a light blocking property.

3. The image carrier unit of claim 1, wherein said seal member comprises:
a central cover portion;
a turned-back portion at which the central cover portion is turned-back on itself; and
reinforcement portions formed at side edges of said central cover portion and turned-back portion, said reinforcement portions being adhered to said housing.

4. The image carrier unit of claim 3, wherein said housing further comprises:
a guide portion configured to receive the reinforcement portions of said seal member.

5. The image carrier unit of claim 3, wherein said seal member further comprises a handle portion positioned at a front end of said central cover portion, and wherein said handle portion is connected to part of said reinforcement portions.

6. The image carrier unit of claim 5, further comprising:
a developing device having a developer accommodation part and a developer seal.

7. The image carrier unit of claim 6, wherein said developer seal is connected to said handle portion.

8. An image carrier unit, comprising:
means for housing components;
means on which an image is formed;
means for exposing a portion of said means on which an image is formed;
means for removably covering said means for exposing by being moved from an installed to an uninstalled position in an axial direction of the means on which an image is formed, and made of a softer material than a material of said means on which an image is formed, said means for removably covering changing its shape when being moved from the installed to the uninstalled position.

9. The image carrier unit of claim 8, wherein said means for housing further comprises:
guide means for receiving portions of said means for removably covering.

10. The image carrier unit of claim 8, wherein said means for removably covering comprises handle means for being grabbed.

11. The image carrier unit of claim 10, further comprising:
developing means having a developer accommodation means and a developer seal means.

12. The image carrier unit of claim 11, wherein said developer seal means is connected to said handle means.

13. An image forming device comprising:
an image carrier unit comprising:
a housing;
an image carrier;
an opening in said housing configured to expose a portion of said image carrier;
a seal member configured to removably cover said opening in said housing by being moved from an installed to an uninstalled position in an axial direction of the image carrier, said seal member made of a softer material than a material of said image carrier, said seal member changing its shape when being moved from the installed to the uninstalled position.

14. The image forming device of claim 13, wherein said seal member has a light blocking property.

15. The image forming device of claim 13, wherein said seal member comprises:
a central cover portion;
a turned-back portion at which the central cover portion is turned-back on itself; and
reinforcement portions formed at side edges of said central cover portion and turned-back portion, said reinforcement portions being adhered to said housing.

16. The image forming device of claim 15, wherein the housing further comprises:
a guide portion configured to receive the reinforcement portions of said seal member.

17. The image forming device of claim 15, wherein said seal member further comprises a handle portion positioned at a front end of said central cover portion, and wherein said handle portion is connected to part of said reinforcement portions.

18. The image forming device of claim 17, further comprising:
a developing device having a developer accommodation part and a developer seal.

19. The image forming device of claim 18, wherein said developer seal is connected to said handle portion.

20. An image forming device comprising:
image carrier means for forming an image, comprising:
means for housing components;
means on which an image is formed;
means for exposing a portion of said image carrier means;
means for removably covering means for said exposing by being moved from an installed to an uninstalled position in an axial direction of the image carrier means, and made of a softer material than a material of said means on which an image is formed, said means for removably covering changing its shape when being moved from the installed to the uninstalled position.

21. The image forming device of claim 20, wherein said means for housing further comprises:
guide means for receiving portions of said means for removably covering.

22. The image forming device of claim 20, wherein said means for removably covering comprises handle means for being grabbed.

23. The image forming device of claim 22, further comprising:

developing means having a developer accommodation means and a developer seal means.

24. The image forming device of claim 23, wherein said developer seal means is connected to said handle means.

25. An image carrier unit, comprising:

a housing;

an image carrier;

an opening in said housing configured to expose a portion of said image carrier;

a seal member configured to removably cover said opening in said housing, said seal member made of a softer material than a material of said image carrier, wherein said seal member comprises:

a central cover portion;

a turned-back portion at which the central cover portion is turned-back on itself; and reinforcement portions formed at side edges of said central cover portion and turned-back portion, said reinforcement portions being adhered to said housing.

26. The image carrier unit of claim 25, wherein said housing further comprises:

a guide portion configured to receive the reinforcement portions of said seal member.

27. The image carrier unit of claim 25, wherein said seal member further comprises a handle portion positioned at a front end of said central cover portion, and wherein said handle portion is connected to part of said reinforcement portions.

28. The image carrier unit of claim 27, further comprising:

a developing device having a developer accommodation part and a developer seal.

29. The image carrier unit of claim 28, wherein said developer seal is connected to said handle portion.

30. An image carrier unit, comprising:

means for housing components;

means on which an image is formed;

means for exposing a portion of said means on which an image is formed;

means for removably covering said means for exposing, and made of a softer material than a material of said means on which an image is formed, wherein said means for removably covering comprises handle means for being grabbed;

developing means having a developer accommodation means and a developer seal means, wherein said developer seal means is connected to said handle means.

31. An image forming device comprising:

an image carrier unit comprising:

a housing;

an image carrier;

an opening in said housing configured to expose a portion of said image carrier;

a seal member configured to removably cover said opening in said housing, said seal member made of a softer material than a material of said image carrier, wherein said seal member comprises:

a central cover portion;

a turned-back portion at which the central cover portion is turned-back on itself; and reinforcement portions formed at side edges of said central cover portion and turned-back portion, said reinforcement portions being adhered to said housing.

32. The image forming device of claim 31, wherein the housing further comprises:

a guide portion configured to receive the reinforcement portions of said seal member.

33. The image forming device of claim 31, wherein said seal member further comprises a handle portion positioned at a front end of said central cover portion, and wherein said handle portion is connected to part of said reinforcement portions.

34. The image forming device of claim 33, further comprising:

a developing device having a developer accommodation part and a developer seal.

35. The image forming device of claim 34, wherein said developer seal is connected to said handle portion.

36. An image forming device comprising:

image carrier means for forming an image, comprising:

means for housing components;

means on which an image is formed;

means for exposing a portion of said image carrier means;

means for removably covering means for said exposing, and made of a softer material than a material of said means on which an image is formed, wherein said means for removably covering comprises handle means for being grabbed; and developing means having a developer accommodation means and a developer seal means, wherein said developer seal means is connected to said handle means.

* * * * *